US011105540B2

(12) United States Patent
Ebara et al.

(10) Patent No.: US 11,105,540 B2
(45) Date of Patent: Aug. 31, 2021

(54) SUPERCONDUCTING MAGNET DEVICE AND CRYOGENIC REFRIGERATOR SYSTEM

(71) Applicant: SUMITOMO HEAVY INDUSTRIES, LTD., Tokyo (JP)

(72) Inventors: Yuta Ebara, Kanagawa (JP); Takaaki Morie, Kanagawa (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 220 days.

(21) Appl. No.: 16/137,145

(22) Filed: Sep. 20, 2018

(65) Prior Publication Data

US 2019/0024950 A1 Jan. 24, 2019

Related U.S. Application Data

(63) Continuation of application No. PCT/JP2017/012143, filed on Mar. 24, 2017.

(30) Foreign Application Priority Data

Mar. 30, 2016 (JP) ..... JP2016-068396

(51) Int. Cl.
*F25B 9/14* (2006.01)
*H01F 6/06* (2006.01)
(Continued)

(52) U.S. Cl.
CPC ..... *F25B 9/14* (2013.01); *H01F 6/04* (2013.01); *H01F 6/06* (2013.01); *H01F 27/29* (2013.01)

(58) Field of Classification Search
CPC . H01F 6/065; H01F 27/29; H01F 6/00; F25B 2400/077; F25B 9/14; H02H 7/008; Y01S 505/00; G01R 33/3815
(Continued)

(56) References Cited

U.S. PATENT DOCUMENTS 4,149,066 A * 4/1979 Niibe ..... H05B 3/36 219/212
4,462,223 A * 7/1984 Perkins ..... F17C 13/10 285/41
(Continued)

FOREIGN PATENT DOCUMENTS

JP S56-040382 U 9/1981
JP S61-046383 U 3/1986
(Continued)

OTHER PUBLICATIONS

International Search Report issued in Application No. PCT/JP2017/012143, dated Jun. 13, 2017.

*Primary Examiner* — Brian M King
(74) *Attorney, Agent, or Firm* — Michael Best & Friedrich LLP

(57) ABSTRACT

A superconducting magnet device includes compressor that compresses a refrigerant gas; a refrigerator that expands the refrigerant gas to generate coldness; a superconducting coil cooled by the refrigerator; a vacuum chamber that houses the superconducting coil; an electrode for a coil that is connected to the superconducting coil and disposed in the outside of the vacuum chamber; a heater that heats the electrode for a coil; a power supply line that connects the compressor and the refrigerator to each other and supplies electrical power from the compressor to the refrigerator; and a branch line that is branched from the power supply line to supply electrical power to the heater.

9 Claims, 6 Drawing Sheets

(51) Int. Cl.
*H01F 6/04* (2006.01)
*H01F 27/29* (2006.01)

(58) Field of Classification Search
USPC ..... 62/51.1; 174/15.4, 15.5, 16.1; 361/22
See application file for complete search history.

(56) References Cited

U.S. PATENT DOCUMENTS

| | | | | |
|---|---|---|---|---|
| 9,985,426 | B2 * | 5/2018 | Jonas | G01R 33/3815 |
| 2011/0056218 | A1 * | 3/2011 | Blakes | H01F 6/02 62/51.1 |
| 2015/0345860 | A1 * | 12/2015 | Rillo Mill N | F25J 1/0276 62/6 |

FOREIGN PATENT DOCUMENTS

| | | | |
|---|---|---|---|
| JP | 2002-089898 | A | 3/2002 |
| JP | 2004-245452 | A | 9/2004 |
| JP | 2005-061803 | A | 3/2005 |
| JP | 2009-283678 | A | 12/2009 |
| JP | 2010-178518 | A | 8/2010 |
| JP | 2011-165887 | A | 8/2011 |

* cited by examiner

SUPERCONDUCTING MAGNET DEVICE AND CRYOGENIC REFRIGERATOR SYSTEM

RELATED APPLICATIONS

Priority is claimed to Japanese Patent Application No. 2016-068396, filed Mar. 30, 2016, and International Patent Application No. PCT/JP2017/012143, the entire content of each of which is incorporated herein by reference.

BACKGROUND

Technical Field

Certain embodiments of the present invention relates to a superconducting magnet device and a cryogenic refrigerator system.

Description of Related Art

In the related art, there is a superconductive magnet including a cryogenic refrigerator (for example, refer to related art). In the superconductive magnet, a coil is cooled by a cryogenic refrigerator, and an electric current flows through the coil in a superconductive state to generate a magnetic field. In the superconductive magnet, the coil is disposed in the inside of a vacuum chamber, and an electrode for flowing an electric current through the coil is disposed in the outside of the vacuum chamber.

SUMMARY

According to an embodiment of the present invention, there is provided a superconducting magnet device of the invention includes compressor that compresses a refrigerant gas; a refrigerator that expands the refrigerant gas to generate coldness; a superconducting coil that is cooled by the refrigerator; a vacuum chamber that houses the superconducting coil; an electrode for a coil that is connected to the superconducting coil and disposed in the outside of the vacuum chamber; a heater that heats the electrode for a coil; a power supply line that connects the compressor and the refrigerator to each other and supplies electrical power from the compressor to the refrigerator; and a branch line that is branched from the power supply line to supply electrical power to the heater.

Additionally, according to another embodiments of the present invention, there is provided a cryogenic refrigerator system of the invention includes a compressor that compresses a refrigerant gas; a refrigerator that expands the refrigerant gas to generate coldness; a power supply line that connects the compressor and the refrigerator to each other and supplies electrical power from the compressor to the refrigerator; and a branch line that is branched from the power supply line to supply electrical power to an electrical device.

Additionally, according to still another embodiments of the present invention, there is provided a cryogenic refrigerator system of the invention includes a compressor that compresses a refrigerant gas; a refrigerator that expands the refrigerant gas to generate coldness; a power supply line that supplies electrical power to the refrigerator; and a branch line that is branched from the power supply line in the inside of the compressor to supply electrical power to an electrical device.

DETAILED DESCRIPTION

Figure 1:
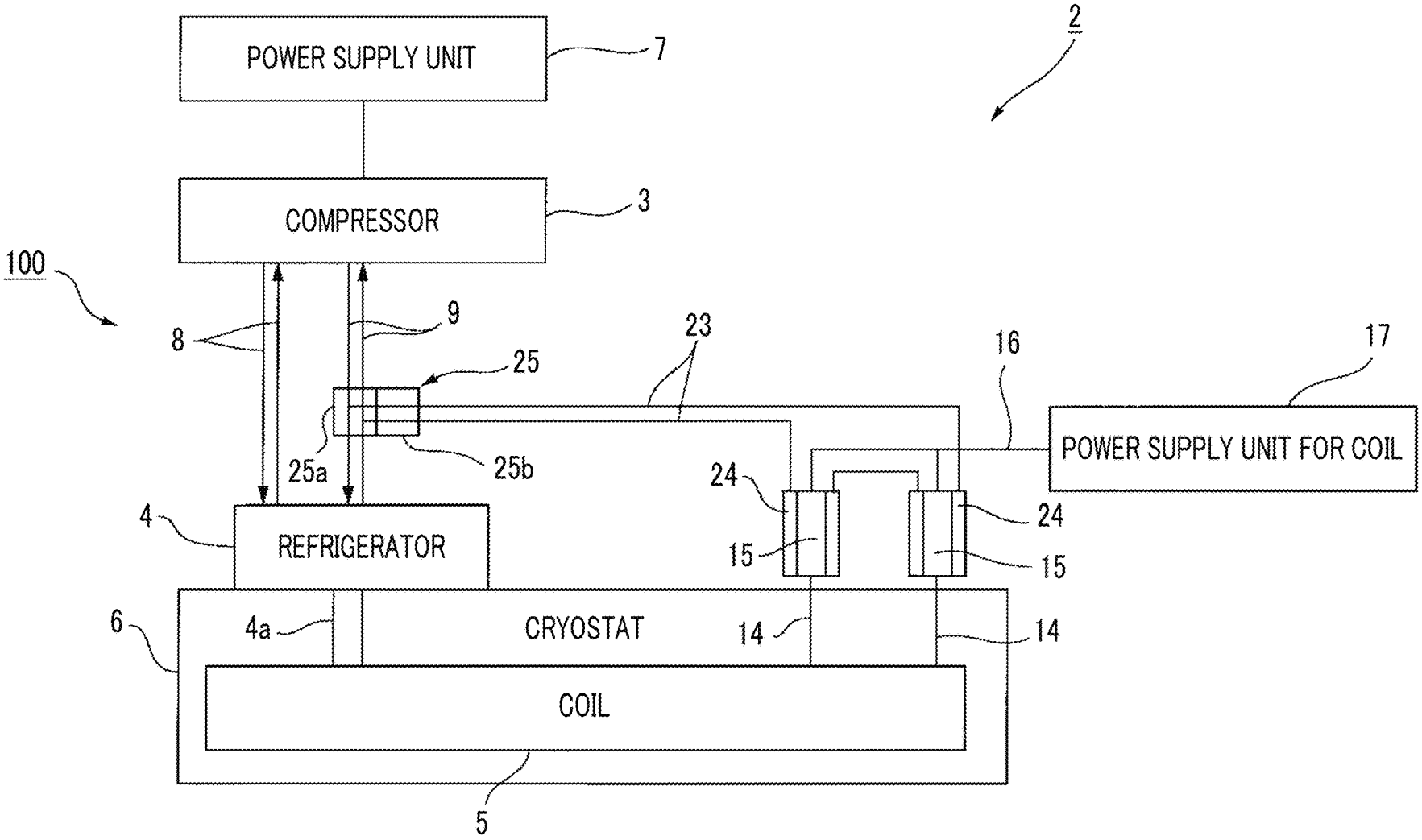
FIG. 1 is a block configuration view illustrating a superconducting magnet device related to an embodiment.

As materials for an electric current line and the electrode that are connected to the coil used in a superconductive state to allow an electric current to flow therethrough, materials having high conductivity are usually used. Since the materials having high conductivity generally also have high thermal conductivity, the electrode, which is connected to the coil and is disposed in the outside of the vacuum chamber, is also cooled if the coil in the inside of the vacuum chamber is cooled. If the electrode disposed in the room temperature state is cooled, there is a concern that the moisture in the air is cooled by the electrode, condensates into dew or freezes, and sticks to the electrode.

It is desirable to provide a superconducting magnet device and a cryogenic refrigerator system capable of reliably suppressing dew condensation or freezing around an electrode with a simple configuration.

According to an embodiment of the present invention, there is provided a superconducting magnet device of the invention includes compressor that compresses a refrigerant gas; a refrigerator that expands the refrigerant gas to generate coldness; a superconducting coil that is cooled by the refrigerator; a vacuum chamber that houses the superconducting coil; an electrode for a coil that is connected to the superconducting coil and disposed in the outside of the vacuum chamber; and a heater that heats the electrode for a coil.

In such a superconducting magnet device, since the heater is provided, dew condensation or freezing around the electrode for a coil disposed in the outside of the vacuum chamber can be suppressed. Specifically, the electrode for a coil can be heated by the heater, and the temperature of the electrode for a coil can be maintained at a temperature equal to or higher than a certain temperature. As a result, cooling of air around the electrode for a coil is suppressed, and dew condensation or freezing is suppressed.

Additionally, the superconducting magnet device may further include a power supply line that connects the compressor and the refrigerator to each other and supplies electrical power from the compressor to the refrigerator, and a branch line that is branched from the power supply line to supply electrical power to the heater. In the superconducting magnet device, the power supply line, which supplies electrical power from the compressor to the refrigerator, is provided and the branch line, which supplies electrical power to the heater, is branched from the power supply line. Accordingly, in a case where electrical power is supplied to the refrigerator, electrical power can be supplied from the branch line to the heater to operate the heater. For that reason, the heater can be operated at a suitable timing in synchronization with the operation of the refrigerator. As a result, forgetting to turn on or off an operation switch of the heater can be prevented, and dew condensation or freezing around the electrode for a coil can be reliably suppressed. Additionally, since the branch line is configured to be branched from the power supply line, it is not necessary to provide an exclusive control circuit, and dew condensation or freezing around the electrode for a coil can be reliably suppressed with a simple configuration.

Additionally, a branch part in which the branch line is branched from the power supply line may be provided close to the refrigerator between the compressor and the refrigerator. Accordingly, since the branch part is disposed close to the refrigerator, the length of the branch line that extends from the branch part to the electrode for a coil can be relatively shortened. For that reason, wiring lines in the superconducting magnet device can be made simple.

Additionally, the branch part in which the branch line is branched from the power supply line may include a connector unit that detachably connects the branch line to the power supply line, and the connector unit may have a female connector that is on the power supply line side, and a male connector that is located on the branch line side and is connected to the female connector. In this way, in a case where the branch line is not connected by disposing the female connector on an upstream side close to the power supply, terminals can be prevented from being exposed to the outside on the power supply line side. If a terminal connected to the power supply line is exposed to the outside, there is a concern that terminals may be electrically connected to each other and problems may occur.

Additionally, the heater may be sheet-like, and the sheet-like heater may be fixed to each of a plurality of the electrodes for a coil. Accordingly, by fixing the sheet-like heater to the electrode for a coil to heat the electrode for a coil and by covering the electrode for a coil with the sheet-like heater, any contact between the electrode for a coil and surrounding air can be suppressed, and dew condensation or freezing around the electrode for a coil can be reliably suppressed.

Additionally, according to another embodiments of the present invention, there is provided a cryogenic refrigerator system of the invention includes a compressor that compresses a refrigerant gas; a refrigerator that expands the refrigerant gas to generate coldness; a power supply line that connects the compressor and the refrigerator to each other and supplies electrical power from the compressor to the refrigerator; and a branch line that is branched from the power supply line to supply electrical power to an electrical device.

According to the cryogenic refrigerator system of this configuration, the refrigerator includes the power supply line that supplies electrical power from the compressor, and the branch line, which supplies electrical power to an electrical device, is branched from the power supply line. Accordingly, in a case where electrical power is supplied to the refrigerator, electrical power can be supplied from the branch line to the electrical device to operate the device. For that reason, in a case where the refrigerator is operated, the electrical device can be operated at a suitable timing in synchronization with the operation of the refrigerator. For example, forgetting to turn on or off an operation switch of the electrical device can be prevented.

Additionally, according to still another embodiments of the present invention, there is provided a cryogenic refrigerator system of the invention includes a compressor that compresses a refrigerant gas; a refrigerator that expands the refrigerant gas to generate coldness; a power supply line that supplies electrical power to the refrigerator; and a branch line that is branched from the power supply line in the inside of the compressor to supply electrical power to an electrical device.

According to the cryogenic refrigerator system of this configuration, the refrigerator includes the power supply line that supplies electrical power from the compressor, and the branch line, which supplies electrical power to an electrical device, is branched from the power supply line. Accordingly, in a case where electrical power is supplied to the refrigerator, electrical power can be supplied from the branch line to the electrical device to operate the device. For that reason, in a case where the refrigerator is operated, the electrical device can be operated at a suitable timing in synchronization with the operation of the refrigerator. For example, forgetting to turn on or off an operation switch of the electrical device can be prevented. Additionally, a branch point where the branch line is branched from the power supply line includes a structure with weak mechanical strength, such as a connector or a solder joint. According to this configuration, since the branch line branches from the power supply line in the inside of the compressor, the effect that a failure caused by an external load generated at the time of connection or disconnection of the electrical device can be suppressed is obtained.

According to the embodiments of the invention, it is possible to provide the superconducting magnet device and the cryogenic refrigerator system capable of reliably suppressing dew condensation or freezing around the electrode for a coil with a simple configuration.

Hereinafter, preferred embodiments of the invention will be described in detail, referring to the drawings. In addition, the same portions or equivalent portions in the respective drawings will be designated by the same reference signs, and the duplicate description thereof will be omitted.

A superconducting magnet device 2 of a first embodiment illustrated in FIG. 1 includes a superconducting coil 5, a cryostat 6, and a cryogenic refrigerator system 100 that cools the superconducting coil 5. The cryogenic refrigerator system 100 includes a compressor 3 that compresses a refrigerant gas, and a refrigerator (also referred to as an expander) 4 that expands the refrigerant gas compressed by the compressor 3. Additionally, the cryogenic refrigerator system 100 includes a power supply line 9 and a branch line 23 (to be described below). As the refrigerator 4, for example, a Gif ford McMahon type refrigerator (hereinafter, referred to as a "GM refrigerator") can be used. In addition, the refrigerator may be other than the GM refrigerator, and may be, for example, other refrigerators, such as a Stirling refrigerator, a pulse tube refrigerator, a Solvay refrigerator, and a Vermine refrigerator. The refrigerant gas is, for example, helium gas. The compressor 3 includes a motor (not illustrated) for compressing the refrigerant gas. The motor of a compressor 3 is driven by electrical power being supplied from a power supply unit 7 and compresses the refrigerant gas. In addition, the compressor 3 is unitized by housing a motor, circuits, wiring lines, other components, and the like in a housing. In addition, an example of the internal configuration of the compressor 3 will be described below with reference to FIGS. 5 and 6.

In the compressor 3, generated heat accompanying the compression of the refrigerant gas is cooled by a cooling mechanism (not illustrated). The cooling mechanism is, for example, a water-cooling type or air-cooling type heat exchanger. For that reason, the arrangement of the compressor 3 is limited to a place where the cooling mechanism can be disposed. Meanwhile, since it is necessary to thermally connect the refrigerator 4 to an object to be cooled (superconducting coil 5), the refrigerator 4 may be disposed in the vicinity of the object to be cooled. Therefore, the compressor 3 and the refrigerator 4 may be disposed to be separated from each other to some extent.

The compressed refrigerant gas passes through a circulation path 8 from a discharge port of the compressor 3 and is supplied to the refrigerator 4. The refrigerant gas expanded by the refrigerator 4 passes through the circulation path 8 and is exhausted to an intake port of the compressor 3. The circulation path 8 includes a piping route for circulating the refrigerant gas between the compressor 3 and the refrigerator 4.

The refrigerator 4 has a cylinder 4*a* that receives the refrigerant gas compressed by the compressor 3. A switching valve, such as a rotary valve, is provided between the cylinder 4*a* and the compressor 3. If the switching valve is driven and the cylinder 4*a* is connected to the discharge port of the compressor 3, a high-pressure refrigerant gas is supplied from the discharge port of the compressor 3 to the cylinder 4*a* thereof. Moreover, if the switching valve is driven and the cylinder 4*a* is connected to the intake port of the compressor 3, the refrigerant gas expanded within the cylinder 4*a* is exhausted to the intake port of the compressor 3. Such a switching valve and a motor for driving the switching valve may be attached to a container outer wall of the cryostat 6.

The cylinder 4*a* is disposed in the inside of the cryostat 6. The cylinder 4*a* has an expansion space, where the refrigerant gas is expanded, at a distal end thereof. In a case where the refrigerator 4 is the GM refrigerator, the size of the expansion space is changed due to movement of a displacer. By synchronizing the movement of the displacer with the timing of the switching valve, the refrigerant gas within the expansion space adiabatically expands to generate coldness. A cooling stage that transmits the coldness generated within the expansion space to the superconducting coil 5 is provided at an outer periphery of the distal end of the cylinder 4*a*.

The compressor 3 and the refrigerator 4 are not simultaneously operated and each thereof is not independently operated in a normal operation. For that reason, since the switching valve and the displacer of the refrigerator 4 are driven, exclusive power supply lines are not provided in many cases. For that reason, the superconducting magnet device 2 includes the power supply line 9 that electrically connect the compressor 3 and the refrigerator 4 to each other. The electrical power output from the power supply unit 7 passes through via the power supply line 9 and is supplied to the refrigerator 4 via the compressor 3. The electrical power supplied to the refrigerator 4 is used for driving of the switching valve and the displacer.

Figure 2:
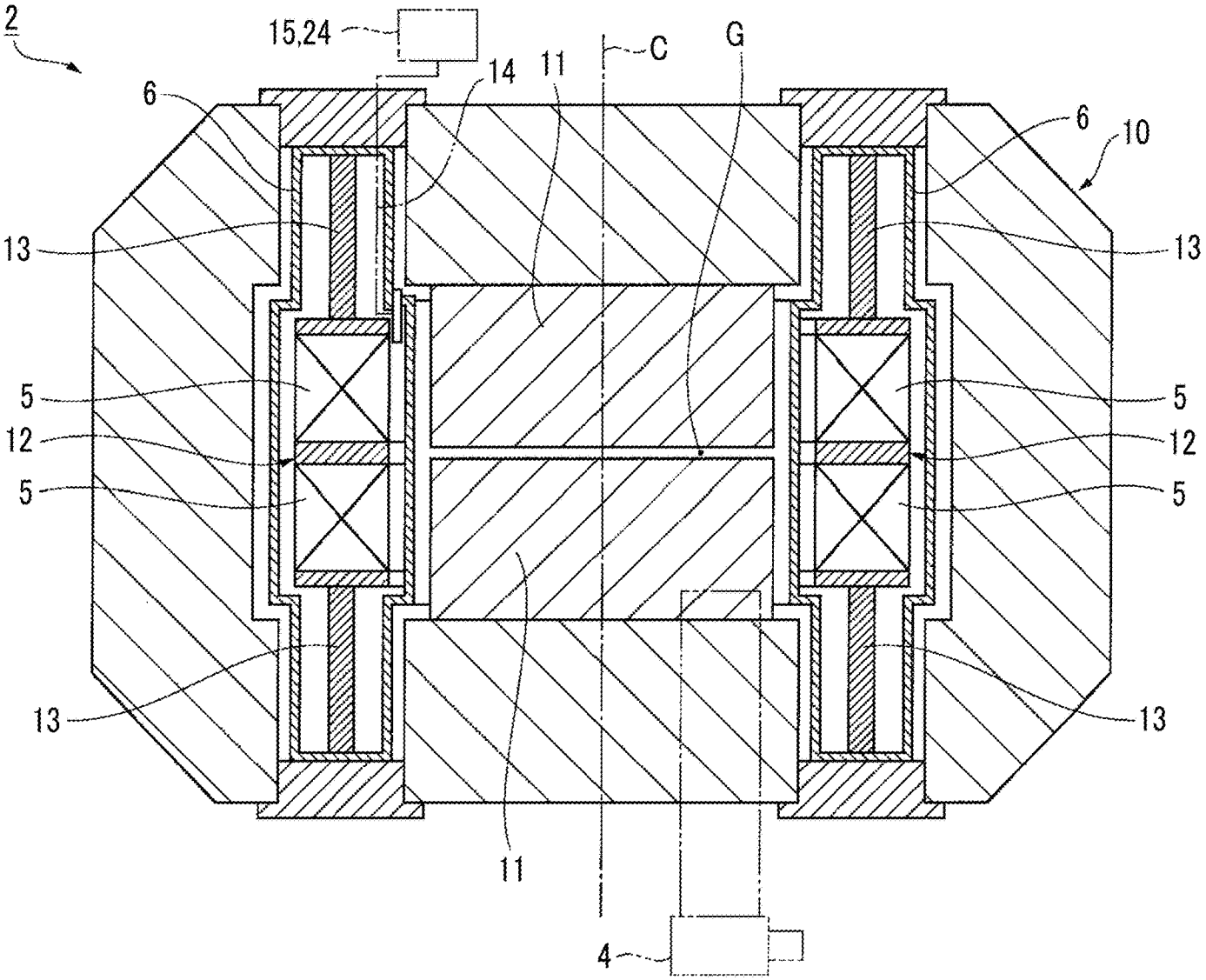
FIG. 2 is a schematic sectional view illustrating the superconducting magnet device.

As illustrated in FIG. 2, the superconducting magnet device 2 has two superconducting coils 5 and 5 disposed on a central axis C. The superconducting coils 5 and 5 are housed in the cryostat 6 including a vacuum chamber.

The superconducting magnet device 2 may further include a yoke 10 and a pair of poles 11. The yoke 10 is a hollow disk-shaped block and the cryostat 6 is disposed in the inside of the yoke 10.

The cryostat 6 has an annular hollow part and the superconducting coils 5 are housed in the hollow part. An annular coil supporting member 12 that supports the superconducting coils 5, and a rod-shaped supporting member 13 that supports the coil supporting member 12 are disposed in the inside of the cryostat 6. The annular coil supporting member 12 is a frame that supports the pair of superconducting coils 5. The rod-shaped supporting member 13 extends in a direction of the central axis C of the superconducting coils 5 and is disposed on both sides of the coil supporting member 12. A plurality of the rod-shaped supporting members 13 is disposed in a circumferential direction of the superconducting coils 5.

The pair of poles 11 may be disposed at least in an empty core region of the cryostat 6 (an empty core region of the superconducting coils). For example, the pair of poles 11 is disposed to face each other in a direction in which the central axis C extends.

Moreover, the superconducting magnet device 2 has an electric current introduction line 14 connected to the superconducting coils, and a pair of electrodes 15 for a coil connected to the electric current introduction line 14. The electric current introduction line 14 passes through the cryostat 6, and the superconducting coils 5 and the electrodes 15 for a coil are electrically connected to each other.

The electrodes 15 for a coil are disposed in the outside of the cryostat 6 and in the outside of the yoke 10. The electrodes 15 for a coil are disposed, for example, on an outer surface 6*a* (refer to FIG. 3) of the cryostat 6. In this way, the electrodes 15 for a coil are fixed to an outer wall of the cryostat 6 in a state where the electrodes 15 for a coil are insulated from the cryostat 6. In addition, the electrodes 15 for a coil may be fixed to the yoke 10.

Figure 3:
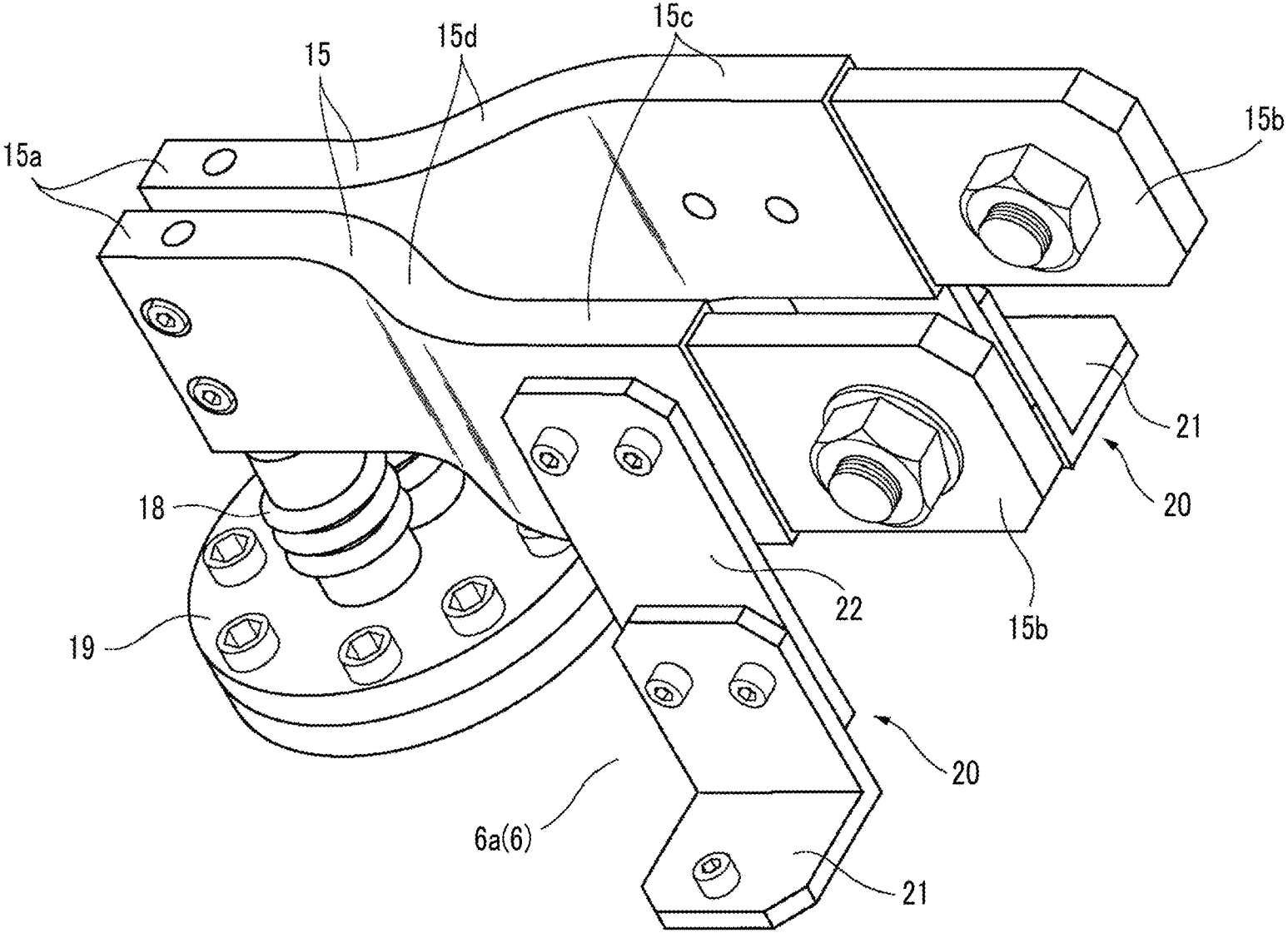
FIG. 3 is a perspective view illustrating electrodes for a coil.

FIG. 3 is a perspective view illustrating the pair of electrodes for a coil. As illustrated in FIG. 3, the electrodes 15 for a coil are, for example, conductors, such as copper, are plate-shaped, and have a predetermined length.

A proximal end 15*a* of an electrode 15 for a coil is connected to the electric current introduction line 14, and a distal end 15*b* of the electrode 15 for a coil is connected to a power supply cable 16 (refer to FIG. 1) for a coil. The power supply cable 16 for a coil is electrically connected to a power supply unit 17 for a coil, as illustrated in FIG. 1.

As illustrated in FIG. 3, the pair of electrodes 15 for a coil is disposed to face each other in a thickness direction of the conductors. The proximal ends 15*a* of the pair of electrodes 15 for a coil are disposed in proximity to each other, and the distal ends 15*b* of the pair of electrodes 15 for a coil are disposed to be separated from each other. A distance between the distal ends 15*b* is larger than a distance between the proximal ends 15*a*.

The electric current introduction line 14 passes through the vacuum chamber constituting the cryostat 6, is delivered to an outer surface side of the cryostat 6, and is connected to the proximal ends 15*a* of the pair of electrodes 15 for a coil. The proximal ends 15*a* of the pair of electrodes 15 for a coil are supported by the outer surface 6*a* of the cryostat 6 via an insulator 18 that allows the electric current introduction line 14 pass therethrough. A flange 19 is coupled to one end of the insulator 18 and the flange 19 is fixed to the cryostat 6 with bolts.

Additionally, an intermediate part 15*c* of each electrode 15 for a coil are fixed to the outer surface 6*a* of the cryostat 6 by an electrode supporting member 20. As illustrated in FIG. 3, a portion from the intermediate part 15*c*, which is not connected to the power supply cable 16 for a coil, to the proximal end 15*a* may be covered with a cover 15*d* of an insulating material. The electrode supporting member 20 includes, for example, an L-shaped support bracket 21 and a support plate 22 made of resin having insulation. The support bracket 21 is fastened to the outer surface 6*a* of the cryostat 6 with screws. Similarly, one end of the support plate 22 is fastened to the support bracket 21 with screws, and the other end of the support plate 22 is fastened to the intermediate part 15*c* of the electrode 15 for a coil with screws. Accordingly, the pair of electrodes 15 for a coil is insulated from the outer surface 6*a* of the cryostat 6 and is supported at a predetermined distance therefrom. In addition, the pair of electrodes 15 for a coil may be supported by an outer surface of the yoke 10.

Figure 4:
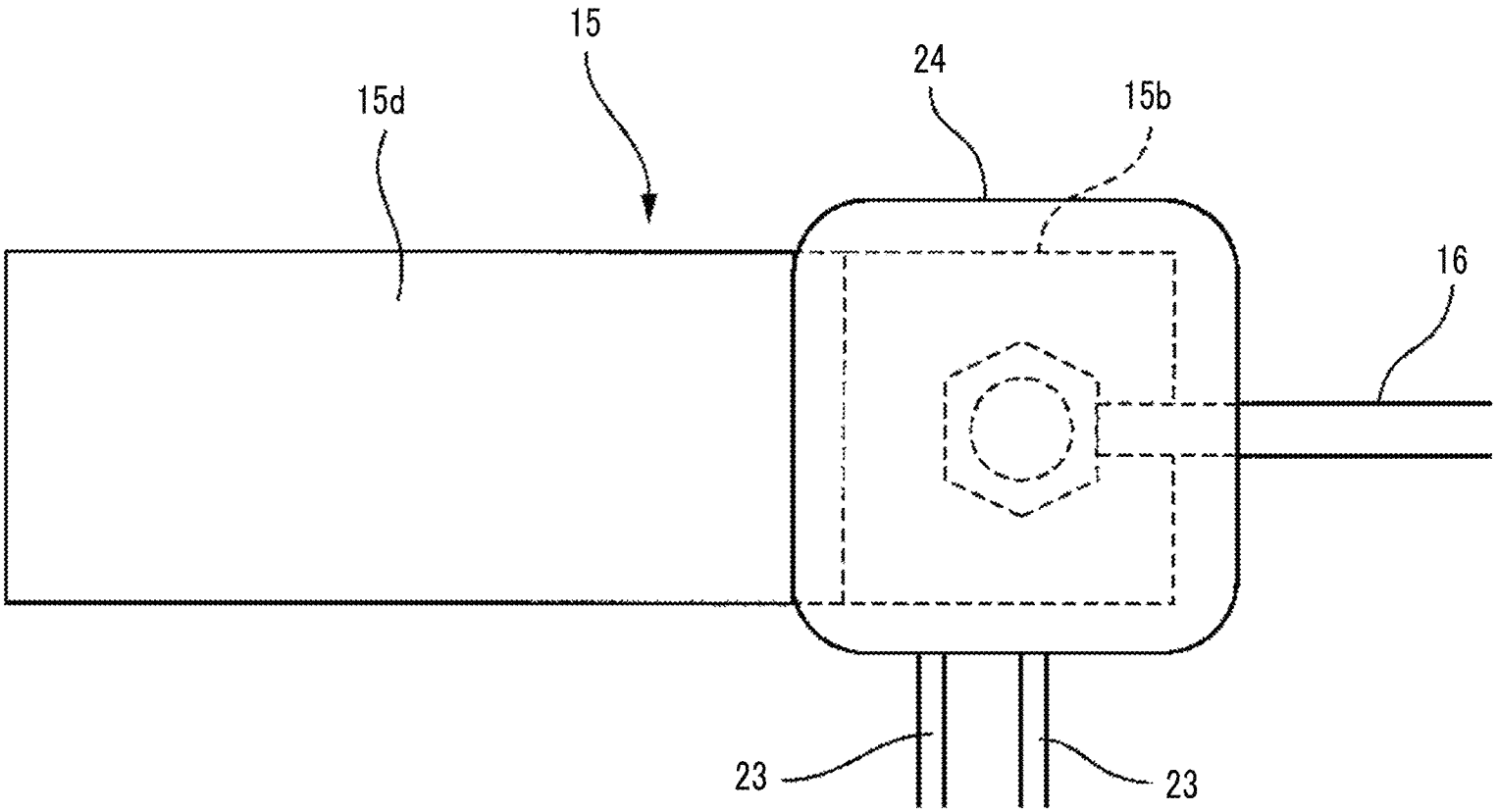
FIG. 4 is a side view illustrating an electrode for a coil in a state where a sheet-like heater is wound.

Here, as illustrated in FIGS. 1 and 4, the superconducting magnet device 2 has the branch line 23 branched from the power supply line 9, and heaters 24 that heat the electrodes 15 for a coil.

The branch line 23 is an electric wire cable that is connected to the power supply line 9 and the heaters 24 and supplies electrical power to the heaters 24. A branch part branched from the power supply line 9 is provided with a connector unit 25. The connector unit 25 has a female connector 25*a* connected to the power supply line 9 that is the power supply unit 7 side (upstream side), and a male connector 25*b* connected to the branch line 23 that is the heater 24 side (downstream side). The male connector 25*b* is provided with pin members, and the female connector 25*a* is provided with recesses into which the pin members of the male connector 25*b* are inserted. The pin members of the male connector 25*b* are inserted into the recesses of the female connector 25*a*, the male connector 25*b* and the female connector 25*a* are connected to each other, and the power supply line 9 and the branch line 23 are electrically connected to each other.

Additionally, the female connector 25*a* that is a branch part is provided closer to the refrigerator 4 than the compressor 3, in the power supply line 9. Since the branch part is provided closer to the refrigerator 4 than the compressor 3, the length (the length of the branch line 23) from the branch part branched from the power supply line 9 to the electrode 15 for a coil can be shortened. By shortening the length of the branch line 23, wiring lines around the superconducting magnet device 2 can be simplified.

Each heater 24 is, for example, a sheet-like heater. A heating wire that is a heat-generating part of the heater 24 is covered with a sheet-like sheathing member. As the heater 24, for example, a rubber heater (made by SAKAGUCHI E. H. VOC CORP) can be used. As electrical power is supplied from the compressor 3 via the power supply line 9 and the branch line 23 to the heater 24, heat is generated. The amount of heat generated by the heater 24 is, for example, about 5 W. As the heater 24, a radiation-type heater, such as an infrared heater, may be used.

As illustrated in FIG. 4, the heater 24 is wound around the distal end 15*b* of the electrode 15 for a coil and covers an outer surface of the electrode 15 for a coil. The heater 24 is bonded to the electrode 15 fora coil, for example, an adhesive. The heater 24 may be fixed to the electrode 15 for a coil, for example, using a beltlike fastening member. The heater 24 may be mechanically fastened with bolts or the like, for example, in a state where the heater 24 is sandwiched between a hard plate and the electrode 15 for a coil. The surface of the heater 24 may be covered with an insulator, such as silicon rubber.

Additionally, the heater 24 may be disposed so as to cover a portion of the outer surface of the electrode 15 for a coil and may be disposed so as to cover the entire outer surfaces of the electrode 15 for a coil. Additionally, a region of the outer surface of the electrode 15 for a coil, which is not covered with the heater 24, may be covered with, for example, a heat-insulating material or a heat reserving material.

Next, the operation of the superconducting magnet device 2 will be described.

First, electrical power is supplied from the power supply unit 7 to the compressor 3. Additionally, along with this, electrical power is supplied from the compressor 3 via the power supply line 9 to the refrigerator 4, and electrical power is supplied to the heater 24 via the branch line 23 branched from the power supply line 9.

Electrical power is supplied to the compressor 3, the motor of the compressor 3 is driven, and the refrigerant gas is compressed. The refrigerant gas compressed by the compressor 3 is supplied to the refrigerator 4 through the circulation path 8. Additionally, electrical power is supplied to the refrigerator 4, and the motor of the refrigerator 4 is driven. The refrigerator 4 expands the refrigerant gas within the cylinder 4*a* to generate coldness to cool the superconducting coils 5. The superconducting coils 5 are cooled to, for example, 4.2 K.

In synchronization with electrical power being supplied to the refrigerator 4, electrical power is supplied to the heaters 24, and the heaters 24 generate heat. The heat generated by the heaters 24 is transferred to the pair of electrodes 15 for a coil. The temperature of the outer surfaces of the pair of electrodes 15 for a coil is maintained at, for example, 15° C. to 40° C.

After the superconducting coils 5 are cooled and are subjected to superconductive transition, a high electric current is supplied from the power supply unit 17 for a coil to the superconducting coils 5, and the superconducting magnet device 2 generates a strong magnetic field.

Such a superconducting magnet device 2 can heat the pair of electrodes 15 for a coil with the heaters 24 to maintain the electrodes 15 for a coil at a predetermined temperature. Accordingly, cooling of air around the electrodes 15 for a coil is suppressed, and dew condensation or freezing is suppressed.

Additionally, since the heaters 24 are sheet-like and the sheet-like heaters 24 are wound around the electrodes 15 fora coil, the electrodes 15 fora coil can be heated, any contact between the electrode 15 for a coil and surrounding air can be suppressed, and dew condensation or freezing can be reliably suppressed.

In the superconducting magnet device 2, in a case where electrical power is supplied to the refrigerator 4, electrical power is supplied to the heaters 24 via the branch line 23 branched from the power supply line 9. For that reason, the heaters 24 can be operated at a suitable timing in synchronization with the operation of the refrigerator 4. Additionally, there is no concern of forgetting to turn on an operation switch, and the heaters 24 can be reliably operated to suppress dew condensation or freezing around the electrodes 15 for a coil.

Additionally, in a case where the supply of the electrical power to the refrigerator 4 is stopped when the operation of the refrigerator 4 is stopped, the supply of the electrical power to the heaters 24 is also stopped. Accordingly, forgetting to turn off the heaters 24 can be prevented, and there is no concern of occurrence of problems, such as burning out of the heating wire due to forgetting to turn off the heaters 24.

Additionally, in the superconducting magnet device 2, the branch line 23 is configured to be branched from the power supply line 9, and it is not necessary to provide an exclusive control circuit that controls the operation of the heaters 24. Thus, dew condensation or freezing around the electrodes 15 for a coil can be reliably suppressed with a simple configuration.

Additionally, the branch part between the power supply line 9 and the branch line 23 includes the connector unit 25 that detachably connects the branch line 23 to the power supply line 9, and the connector unit 25 has the female connector 25*a* on the power supply line 9 side, and the male connector 25*b* that is located on the branch line 23 side and is connected to the female connector 25*a*. Accordingly, in a case where the heaters 24 are replaced, detachment or attachment can be easily performed together with the branch line 23. Additionally, since the female connector 25*a* is disposed on the power supply unit 7 side, there is no concern that a terminal may be exposed on the power supply line 9 side in a state where the branch line 23 is not connected. If a terminal on the power supply line 9 side is exposed to the outside, there is a concern that terminals may be electrically connected to each other and problems may occur.

Next, a superconducting magnet device related to a second embodiment will be described. The superconducting magnet device of the second embodiment is different from the superconducting magnet device 2 of the first embodiment in that a blower (not illustrated) is provided instead of the heaters 24. The blower is, for example, a fan and blows air against the electrodes 15 for a coil. Each of the pair of electrodes 15 for a coil may be provided with the blower, and air may be blown against the pair of electrodes 15 for a coil using a common blower.

The branch line 23 is connected to the blower. Electrical power is supplied from the compressor 3 via the power supply line 9 to the refrigerator 4, and electrical power is supplied to the blower via the branch line 23. Accordingly, the blower is operated to blow air against the pair of electrodes 15 for a coil.

In this way, by blowing air against the electrodes 15 for a coil, surrounding air can be kept away from the electrodes 15 for a coil before surrounding air is cooled, due to the heat exchange between the electrodes 15 for a coil and the surrounding air, and the surrounding air of the electrodes 15 for a coil can always be maintained near the room temperature. For that reason, cooling of the electrodes 15 for a coil is suppressed, and dew condensation or freezing is suppressed.

The invention is not limited to the aforementioned embodiments, and various modifications can be made as follows without departing from the concept of the invention.

Although the superconducting magnet device 2 are described in the above embodiments, a cryogenic refrigerator system can be applied to a superconducting cyclotron (accelerator) that accelerates a charged particle, a deflecting electromagnet that deflects the charged particle, and the like. Examples of the charged particle include a proton, a baryon (heavy ion), an electron, and the like.

Additionally, in the above embodiments, the sheet-like heaters are used by being wound around the electrodes for a coil. However, the heaters are limited to the sheet-like heaters, and may be heaters having other shapes, such as a plate shape, a rod shape, a block shape, and a tubular shape. Additionally, ceramic heaters or metal heaters may be used as the heaters. Additionally, the heaters may be used in contact with the electrodes, or the heaters may be disposed at positions away from the electrodes.

Additionally, in the above embodiments, each of the pair of electrodes 15 for a coil is provided with a heater 24. However, a configuration in which the pair of electrodes 15 for a coil is provided with one heater 24 may be adopted. For example, the pair of electrodes 15 for a coil may be heated via a heat transfer member. Additionally, a configuration in which one electrode 15 for a coil is provided with a plurality of heaters 24 may be adopted.

Additionally, in the above embodiments, electrical power is supplied to the heaters 24 or the blower via the branch line 23. However, other electrical devices may be connected to the branch line 23, and the electrical devices may be operated in synchronization with the operation of the refrigerator 4. Examples of the electrical devices other than the heaters 24 or the blower include a motor, a sensor, and the like.

Additionally, in the above embodiments, the branch part in which the branch line 23 branches from the power supply line 9 is disposed closer to the refrigerator 4 between the compressor 3 and the refrigerator 4. However, the branch part may be disposed at the intermediate position between the compressor 3 and the refrigerator 4 or may be disposed closer to the compressor 3.

Additionally, in the above embodiments, the female connector 25*a* is provided on the upstream side in a direction in which an electric current flows and the male connector 25*b* is provided on the downstream side in the flow direction. However, a configuration in which the male connector 25*b* is provided on the upstream side and the female connector 25*a* is provided on the downstream side may be adopted.

Additionally, in the above embodiments, a configuration in which the branch line 23 is attachable to and detachable from the power supply line 9 via the detachable connector unit 25 is adopted. However, the branch line 23 may be always connected to the power supply line 9 and may not be attachable and detachable.

Figure 5:
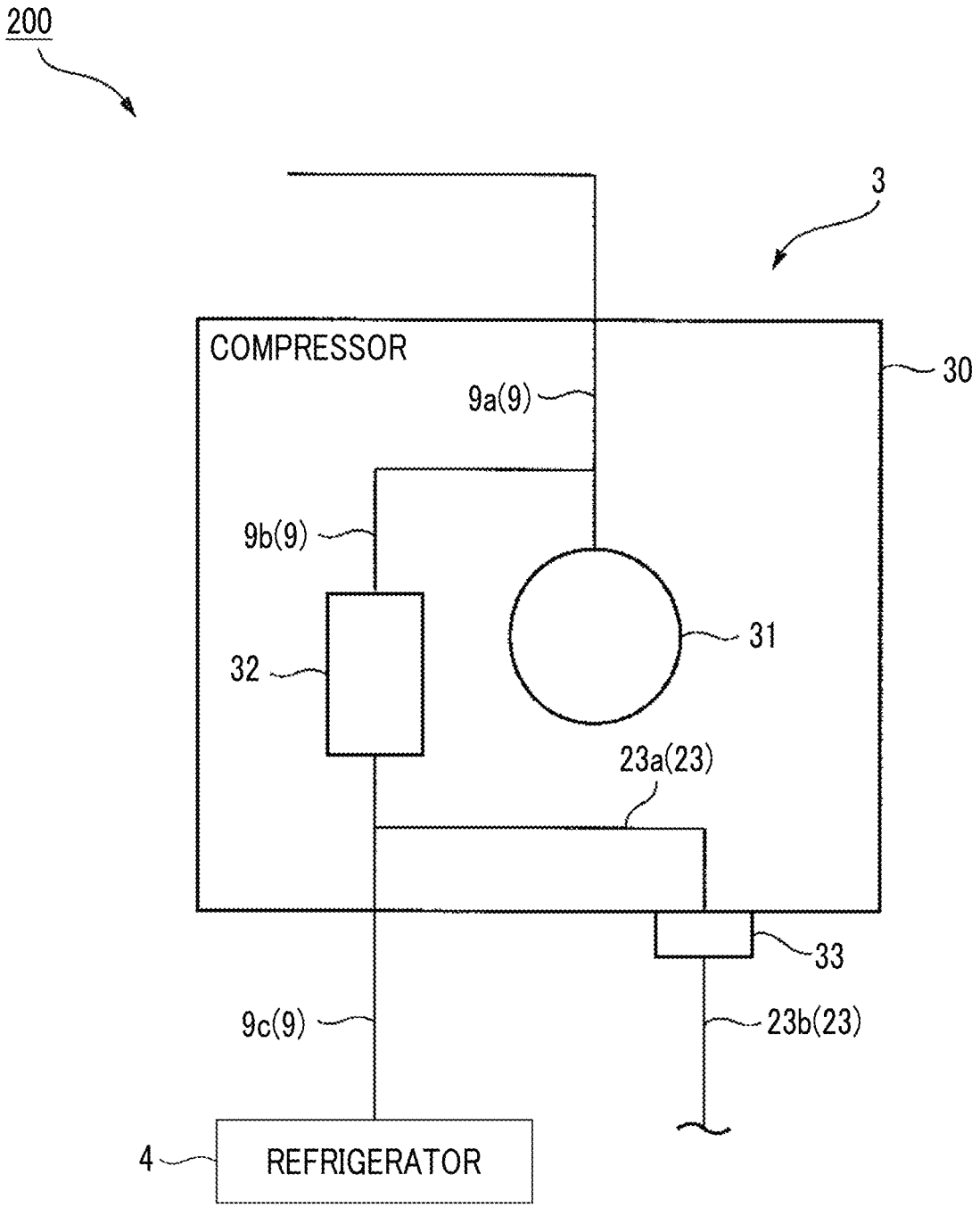
FIG. 5 is a block configuration view illustrating a superconducting magnet device related to a modification example.

For example, as illustrated in FIG. 5, the branch line 23 may be branched from the power supply line 9 in the inside of the compressor 3. That is, a cryogenic refrigerator system 200 illustrated in FIG. 5 may include the compressor 3, the refrigerator 4, the power supply line 9 that supplies electrical power to the refrigerator 4, and the branch line 23 that is branched from the power supply line 9 in the inside of the compressor 3 to supply electrical power to the electrical devices.

The compressor 3 includes a motor 31 functioning as a drive unit of the compressor, a voltage converter 32 having a voltage drop function, and other circuits and components (not illustrated), and is unitized by housing these in the housing 30. In the inside of the compressor 3, the power supply line 9 includes a line 9*a* connected to the motor 31, the voltage converter 32 branched from the line 9*a*, and a line 9*c* that extends from the voltage converter 32 to the outside of the compressor 3 and is connected to the refrigerator 4. Additionally, the branch line 23 includes a line 23*a* that branches from the line 9*c* on the downstream side of the voltage converter 32, and a line 23*b* that extends to the outside of the compressor 3. In this way, since the branch line 23 branches at the line 9*c* on the downstream side of the voltage converter 32, the voltage of the branch line 23 is a voltage after the voltage thereof is adjusted by the voltage converter 32. In addition, the housing 30 may be provided with a connector 33 connected to the line 23*a*, and an electric wire of an electrical device may be connected to the connector 33.

Figure 6:
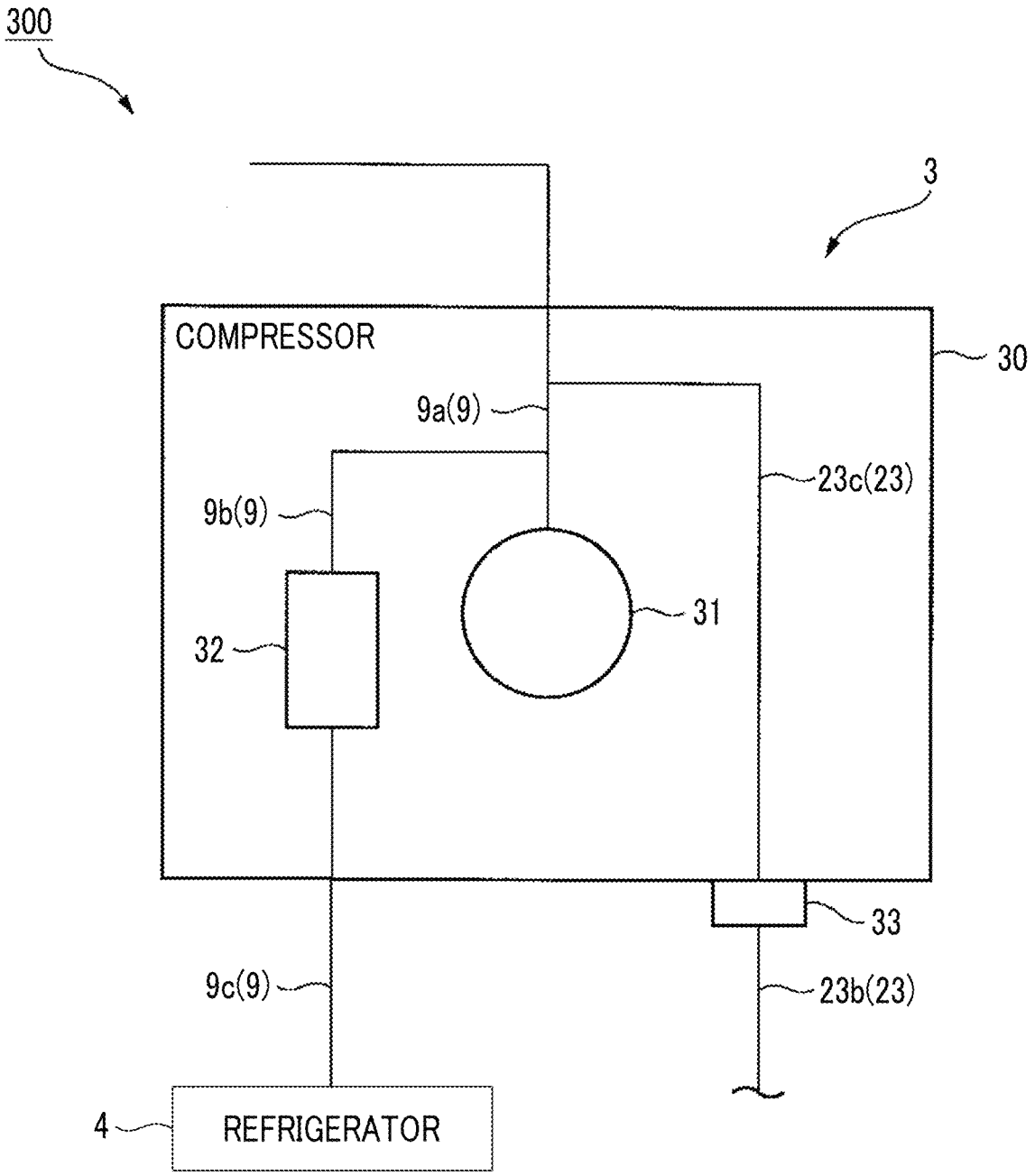
FIG. 6 is a block configuration view illustrating a superconducting magnet device related to a modification example.

Additionally, a cryogenic refrigerator system 300 as illustrated in FIG. 6 may be adopted. In the cryogenic refrigerator system 300, the branch line 23 branches on the upstream side of the motor 31 and the voltage converter 32, that is, at the line 9*a*. More specifically, the line 23*c* of the branch line 23 branches upstream side of the portion of the line 9*a* to which the line 9*b* is connected, in the inside of the compressor 3.

In the above cryogenic refrigerator systems 200 and 300, the branch line branches from the power supply line in the inside of the compressor. A branch point where the branch line is branched from the power supply line includes a structure with weak mechanical strength, such as a connector or a solder joint. According to this configuration, since the branch line branches from the power supply line in the inside of the compressor, the effect that a failure caused by an external load generated at the time of connection or disconnection of the electrical device can be suppressed is obtained.

It should be understood that the invention is not limited to the above-described embodiment, but may be modified into various forms on the basis of the spirit of the invention. Additionally, the modifications are included in the scope of the invention.

What is claimed is:

1. A superconducting magnet device comprising:

a compressor that compresses a refrigerant gas;

a refrigerator that expands the refrigerant gas to generate coldness;

a circulation path that allows the refrigerant gas to flow inside thereof from the compressor to the refrigerator;

a superconducting coil that is cooled by the refrigerator;

a vacuum chamber that houses the superconducting coil;

an electrode for a coil that is connected to the superconducting coil and disposed outside the vacuum chamber;

a heater that heats the electrode for a coil and is disposed outside the vacuum chamber;

a power supply line that electrically connects the compressor and the refrigerator to each other; and a branch line that is branched from a branch part to the heater so as to supply electrical power to the heater, wherein the power supply line comprises a first end connected to the compressor, a second end connected to the refrigerator, and the branch part located between the first end and the second end, and the electrical power is supplied from the compressor to the refrigerator through the power supply line.

2. The superconducting magnet device according to claim 1, wherein the branch part is provided closer to the refrigerator than to the compressor between the compressor and the refrigerator.

3. The superconducting magnet device according to claim 1, wherein the branch part comprises a connector unit that detachably connects the branch line to the power supply line, and wherein the connector unit has a female connector that is located on the power supply line side, and a male connector that is located on the branch line side and is connected to the female connector.

4. The superconducting magnet device according to claim 1, wherein the heater is planar, and the planar heater is fixed to each of a plurality of the electrodes for a coil.

5. A cryogenic refrigerator system comprising:

a compressor that compresses a refrigerant gas;

a refrigerator that expands the refrigerant gas to generate coldness;

a circulation path that allows the refrigerant gas to flow inside thereof from the compressor to the refrigerator;

a power supply line that electrically connects the compressor and the refrigerator to each other; and a branch line that is branched from a branch part to an electrical device so as to supply electrical power from the compressor to the electrical device, wherein the power supply line comprises a first end connected to the compressor, a second end connected to the refrigerator, and the branch part located between the first end and the second end, and the electrical power is supplied from the compressor to the refrigerator through the power supply line, and wherein the electrical device is one of a blower which is disposed outside a vacuum chamber and blows air against an electrode for a coil, and a heater which is disposed outside the vacuum chamber and heats the electrode for a coil.

6. A cryogenic refrigerator system comprising:

a compressor that compresses a refrigerant gas;

a refrigerator that expands the refrigerant gas to generate coldness;

a circulation path that allows the refrigerant gas to flow inside thereof from the compressor to the refrigerator;

a power supply line that comprises a branch part located inside of the compressor and supplies electrical power to the refrigerator; and a branch line that is branched from the branch part to an electrical device so as to supply electrical power to the electrical device, wherein the electrical device is one of a blower which is disposed outside a vacuum chamber and blows air against an electrode for a coil, and a heater which is disposed outside the vacuum chamber and heats the electrode for a coil.

7. The superconducting magnet device according to claim 1, wherein the electrode for a coil is fixed to an outer wall of a cryostat including the vacuum chamber in a state where the electrode for a coil is insulated from the cryostat.

8. The superconducting magnet device according to claim 5, wherein the electrode for a coil is exposed to an atmosphere in a case where the electrical device is the blower.

9. The superconducting magnet device according to claim 6, wherein the electrode for a coil is exposed to an atmosphere in a case where the electrical device is the blower.

* * * * *